US009470143B2

(12) United States Patent
Karrar et al.

(10) Patent No.: US 9,470,143 B2
(45) Date of Patent: Oct. 18, 2016

(54) WORK APPARATUS HAVING A BRAKING ARRANGEMENT

(71) Applicant: Andreas Stihl AG & Co. KG, Waiblingen (DE)

(72) Inventors: Carel Karrar, Stuttgart (DE); Helmut Zimmermann, Berglen (DE); Werner Geyer, Berglen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 671 days.

(21) Appl. No.: 13/929,880

(22) Filed: Jun. 28, 2013

(65) Prior Publication Data

US 2014/0000542 A1 Jan. 2, 2014

(30) Foreign Application Priority Data

Jun. 28, 2012 (DE) ..... 10 2012 012 799

(51) Int. Cl.
*F02B 63/02* (2006.01)
*B27B 17/08* (2006.01)

(52) U.S. Cl.
CPC ..... *F02B 63/02* (2013.01); *B27B 17/083* (2013.01)

(58) Field of Classification Search
CPC .. F02D 11/02; F02D 2011/101; F02B 63/02; B27B 17/083; F02N 15/003
USPC ..... 123/198 D, 179.18
See application file for complete search history.

(56) References Cited

U.S. PATENT DOCUMENTS 4,226,312 A 10/1980 Zindler
4,460,072 A 7/1984 Moerner et al.
4,717,207 A 1/1988 Kubota et al.
4,782,593 A * 11/1988 Kieser ..... B27B 17/083 188/77 R
4,936,429 A 6/1990 Mackoway, Jr. et al.
5,142,934 A * 9/1992 Persson ..... B27B 17/0008 30/381
5,235,943 A 8/1993 Fiorenza, II
5,774,993 A 7/1998 Schlessmann
6,012,420 A 1/2000 Dykstra et al.
6,536,747 B2 3/2003 Burns et al.
7,118,097 B2 10/2006 Moriyama et al.
7,337,757 B2 * 3/2008 Schmidt ..... F02M 1/02 123/179.16
8,113,166 B2 2/2012 Kumagai et al.

(Continued)

FOREIGN PATENT DOCUMENTS

CN 200961516 Y 10/2007
DE 75 26 726 U 12/1975

(Continued)

*Primary Examiner* — Hieu T Vo
*Assistant Examiner* — Arnold Castro
(74) *Attorney, Agent, or Firm* — Walter Ottesen, P.A.

(57) ABSTRACT

A work apparatus has a work tool and a combustion engine for driving the work tool and further includes a start enrichment device for the combustion engine. The start enrichment device has a start position and is actuated via an operating mode selector. The work apparatus has a braking arrangement which brakes the work tool in the actuated position and releases the work tool in the unactuated position, and also an actuating device for the braking arrangement. To ensure that the start position can only be engaged when the braking arrangement is actuated, the work apparatus has a blocking device which prevents engagement of the start position in a blocking position. The braking arrangement is coupled to the blocking device such that the blocking device is in the blocking position with the braking arrangement in the unactuated position.

16 Claims, 8 Drawing Sheets

(56) References Cited

U.S. PATENT DOCUMENTS

| | | | | |
|---|---|---|---|---|
| 8,511,650 | B2 | 8/2013 | Kern et al. | |
| 9,068,533 | B2 * | 6/2015 | Kullik | F02M 1/02 123/179.16 |
| 2002/0112688 | A1 | 8/2002 | Fariz et al. | |
| 2002/0134362 | A1 | 9/2002 | Deutsch | |
| 2005/0022798 | A1 | 2/2005 | Roth et al. | |
| 2006/0070594 | A1 * | 4/2006 | Pattullo | F02M 1/02 123/179.18 |
| 2008/0246170 | A1 * | 10/2008 | Engman | F02D 9/02 261/52 |
| 2008/0305929 | A1 | 12/2008 | Koga | |
| 2009/0193669 | A1 | 8/2009 | Gorenflo | |
| 2010/0224466 | A1 | 9/2010 | Leinmueller et al. | |
| 2010/0237516 | A1 * | 9/2010 | Kern | F02M 1/02 261/64.6 |
| 2012/0190500 | A1 | 7/2012 | Yamada et al. | |
| 2014/0000543 | A1 | 1/2014 | Karrar | |
| 2014/0000544 | A1 | 1/2014 | Karrar | |
| 2014/0005001 | A1 | 1/2014 | Karrar | |
| 2014/0352660 | A1 * | 12/2014 | Kurzenberger | F02D 29/00 123/400 |
| 2014/0366828 | A1 * | 12/2014 | Eberle | F02B 63/02 123/179.1 |

FOREIGN PATENT DOCUMENTS

| | | | |
|---|---|---|---|
| DE | 33 08 400 | A1 | 9/1983 |
| DE | 83 06 837 | U1 | 3/1986 |
| DE | 41 25 846 | A1 | 2/1993 |
| DE | 20 2004 004 467 | U1 | 5/2004 |
| DE | 10 2009 036 372 | A1 | 2/2011 |

* cited by examiner

WORK APPARATUS HAVING A BRAKING ARRANGEMENT

CROSS REFERENCE TO RELATED APPLICATION

This application claims priority of German patent application no. 10 2012 012 799.5, filed Jun. 28, 2012, the entire content of which is incorporated herein by reference.

BACKGROUND OF THE INVENTION

DE 33 08 400 A1 discloses a motor-driven chain saw which has a braking arrangement. The operating mode selector of the motor-driven chain saw is connected via a Bowden cable to a lever part which acts on the band brake of the motor-driven chain saw. If the operating mode selector is set into the start position, the band brake of the motor-driven chain saw is engaged. In order to engage and release the band brake, comparatively large operating forces are required, and so it is unergonomical for the operator to actuate the operating mode selector.

SUMMARY OF THE INVENTION

It is an object of the invention to provide a work apparatus, which has a high level of operating comfort and a simple structure, and in which the braking arrangement is always actuated when the start enrichment device is in a start position.

The work apparatus of the invention includes: a work tool; a combustion engine configured to drive the work tool; a starting enrichment unit configured for the combustion engine and having at least a first starting position; an operating mode selector configured to actuate the first starting position of the starting enrichment unit; a braking arrangement having an actuated position and an unactuated position and being configured to brake the work tool, when in the actuated position and to release the work tool in the unactuated position; an actuating unit configured for the braking arrangement; a blacking device having a blocking position and being configured to prevent the starting enrichment unit from assuming the first starting position when the blocking device is in the blocking position; and, the braking arrangement being coupled to the blocking device so as to cause the blocking device to be in the blocking position when the braking arrangement is in the unactuated position.

By way of a blocking device, the operator can easily be prevented from being able to engage the start position when the braking arrangement is not actuated. Engagement of the start position here refers to an adjustment of the start enrichment device into a start position in which the start enrichment device remains without external action, that is including after an operating mode; selector or the like has been released. If the start position cannot foe engaged, the operator knows that first the braking arrangement has to be engaged before the start position can be engaged. This also prevents accidental engagement of the start position during operation, since the braking arrangement is not active during operation. Only the normal, comparatively small operating forces for engaging the start position have to be applied via the operating mode selector. The blocking device can likewise be actuated with small operating forces. This makes a simple structure of the work apparatus possible.

Advantageously, the start enrichment device has a valve element which is adjustable between an operating position and at least one start position. Advantageously, two start positions, namely a warm start position and a cold start position, are provided so that the work apparatus can be started in a manner suited to the environmental conditions and the temperature of the combustion engine. The valve element is advantageously held in the start position by a fixing device. Advantageously, the blocking device prevents the valve element from being fixed in the start position by the fixing device. The valve element is advantageously mounted in a spring-biased manner in the direction of its operating position and, when the valve element is net fixed by the fixing device, is restored into its operating position by the spring force as soon as the operator releases the operating mode selector. As a result, engagement of the start position, that is fixing of the valve element in the start position, can easily foe prevented.

A valve element is, in particular, a choke element connected to a choke lever. If the choke element cannot, be adjusted into its start position it is as a rule not possible to start the combustion engine. A valve element is advantageously a throttle element connected, to a throttle trigger. It has been shown that it is sufficient to avoid adjustment of a throttle element into its start position, that is usually a slightly open position, in order that the combustion engine cannot be started.

Advantageously, the choke element, and the throttle element are adjusted into a start position when the start position is engaged. The free flow cross section of an intake channel of the combustion engine, the throttle element opening this free flow cross section in the start position, is advantageously larger than the flow cross section opened in the unactuated position of the throttle element. The choke element advantageously does not substantially reduce the flow cross section of the intake channel in the operating position. In the start position, the free flow cross section of the intake channel is advantageously reduced very considerably by the choke element. Advantageously, the throttle trigger interacts with the choke lever to fix a start position of at least one valve element. This results in a simple structure. The throttle trigger and the choke lever are advantageously arranged in a conventional manner on the outer side of a carburetor of the work apparatus.

Advantageously, the blocking device prevents a valve element from being fixed in a start position. In particular the blocking device prevents engagement of the throttle trigger with the choke lever. Since the throttle trigger cannot engage with the choke lever and fix the choke lever in the start position of the choke element, the choke element does not remain in the start position. Accordingly, the choke element can foe adjusted as far as the start position, but is restored advantageously back into the operating position after the operating mode selector has been released. It is not possible to engage the start position, that is to adjust the start enrichment device into a start position in which the start enrichment device remains without external action. Alternatively, it is possible to prevent the throttle element from being fixed in its start position, in particular when the operating mode selector acts on the throttle element. The throttle element is advantageously not fixed in its start position, but is restored back into its operating position after the operating mode selector has been released, such that the start position cannot be engaged and thus the throttle element does not remain in the start position without, external action.

A simple structure is achieved when the choke lever is mounted on a choke shaft and the throttle trigger is mounted on a throttle shaft. Advantageously, the choke lever is held on the choke shaft so as to rotate therewith and the throttle trigger is held on the throttle shaft so as to rotate therewith. Advantageously, at least one of the levers is mounted on its shaft so as to be displaceable in the longitudinal direction of its pivot axis. The blocking device advantageously has a displacement contour which moves at least one of the levers in the longitudinal direction of its pivot axis. As a result, it is easily possible for the levers not to come into engagement with one another.

By way of the displacement contour, an already engaged start position is advantageously also released again when the braking arrangement is released. The lever is displaced advantageously counter to the force of a spring. The spring is in this case advantageously a torsion spring which biases the respective lever into its unactuated position. In this case, the throttle trigger is spring-biased in the direction of the completely closed position of the throttle element and the choke lever is spring-biased in the direction of the completely open position of the choke element. Because the lever is adjusted counter to the force of a spring, when the blocking device is restored, that is when the braking arrangement is actuated, the lever is adjusted into its not disengaged position and can thus come back into engagement with the other lever.

A simple structure can also be achieved if the blocking device prevents a movement of the valve element into the start position. This can in a simple manner take place in that the blocking device extends in the movement path of one of the components that move when the start position is engaged. A simple structure is achieved when the valve element is intended to be actuated by the operating mode selector via a coupling rod and the blocking device is arranged in the adjustment path of the coupling rod. However, it is also possible to provide for the blocking device to block the movement path of the operating mode selector, for example by blocking the shift gate. It is also possible to block the movement path of a lever connected to the valve element, in particular a choke lever or throttle trigger, by way of the blocking device. Advantageously, the valve element is spring-biased in the direction of its operating position and pivots back into its operating position on account of the spring force when the operating mode selector is released.

In order to ensure that the start enrichment device is released from the start position when the braking arrangement is released, it is provided for the blocking device to have an actuating contour which releases the start enrichment device from the start position when the braking arrangement is released, while the start enrichment device is in the start position. This makes it possible to avoid an operator first of all being able to adjust the start enrichment device into the start, position and subsequently being able to release the brake. In this case, the start position of the start enrichment device is also released. The actuating device for the braking arrangement is advantageously a hand protection bracket. The work apparatus is in particular a handheld work apparatus, advantageously a motor-driven chain saw. A simple structure is achieved when the braking arrangement comprises a differential band brake. A differential band brake acts in a self-reinforcing manner and can be actuated with small operating forces. This results in ergonomic operation.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
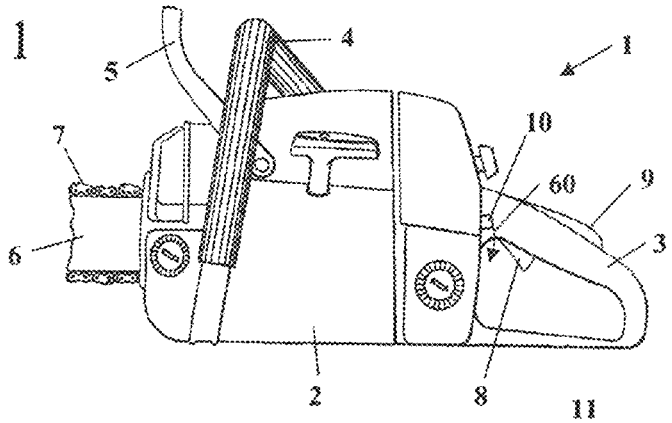
FIG. 1 shows a schematic side view of a motor-driven chain saw.

FIG. 1 shows a handheld motor-driven chain saw 1 as an embodiment of a work apparatus. The motor-driven chain saw 1 has a housing 2 on which a rear handle 3 and a bale handle 4 are secured. The rear handle 3 and the bale handle 4 are decoupled in terms of vibration from a combustion engine 11 (FIG. 2) arranged in the housing 2. A throttle lever 8 and a throttle lever lock 9 are pivotably mounted on the rear handle 3. Next to the rear handle 3, an operating mode selector 10 projects out of the housing 2. On the side remote from the rear handle 3, a guide rail 6 projects forward from the housing 2. A saw chain 7, which is driven by the combustion engine 11, is arranged in a circulating manner on the guide rail 6. On the side of the bale handle 4 which faces the saw chain 7 there is arranged a hand protection bracket 5 which is mounted pivotably on the housing 2.

Figure 2:
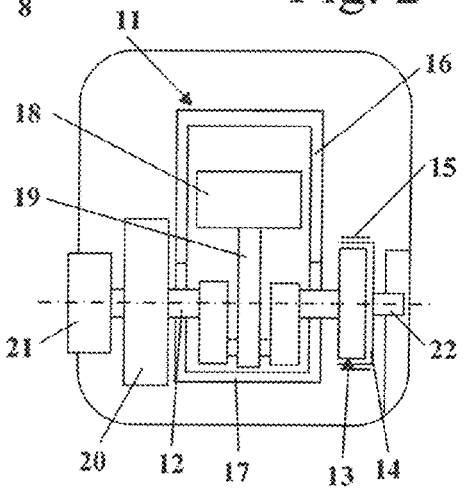
FIG. 2 shows a schematic section through the motor-driven chain saw of FIG. 1.
Figure 3:
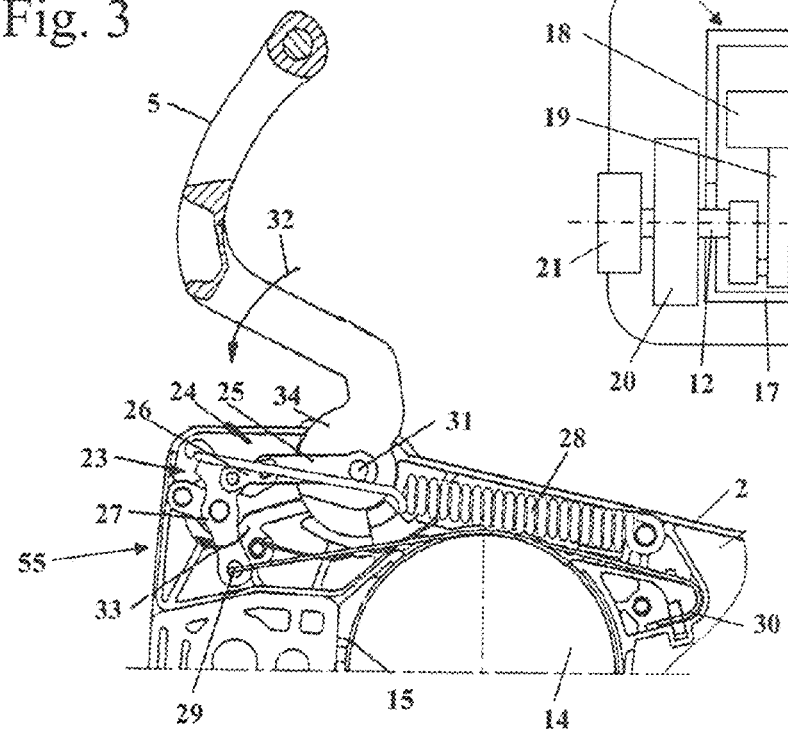
FIG. 3 shows a schematic section through the motor-driven chain saw in the region of the braking arrangement.

FIG. 2 shows the structure of the drive of the motor-driven chain saw 1 in detail. The combustion engine 11 has a cylinder 16 in which a piston 18 is mounted in a reciprocating manner. Via a connecting rod 19, the piston 18 drives a crankshaft 12 mounted rotatably in a crankcase 17. The combustion engine 11 is advantageously a single-cylinder engine, in particular a two-stroke engine. Secured to the crankshaft 12 is a fan wheel 20 which serves to deliver cooling air for the combustion engine 11. Arranged on the side of the fan wheel 20, which faces away from the combustion engine 11, is a starter device 21 which serves to start up the combustion engine 11. The starter device 21 is advantageously a manually actuated starter device, for example a pull-rope starter. However, the starter device 21 can also be actuated electrically. On the side of the combustion engine 11, which is remote from the fan wheel 20, a centrifugal clutch 13 is secured to the crankshaft 12. The centrifugal clutch 13 has a clutch drum 14 which simultaneously serves as a brake drum for a braking arrangement 55 (FIG. 3). The braking arrangement 55 is a band brake and has a brake band 15 wrapped around the clutch drum 14. Secured to the clutch drum 14 is a drive sprocket 22 which serves to drive the saw chain 7 around the guide rail 6.

When starting the combustion engine 11, the operator has to actuate the braking arrangement 55 (FIG. 3), that is engage the brake, so that the brake band 15 bears against the clutch drum 14 and brakes the saw chain 7. The braking arrangement 55 is intended to be actuated via the hand protection bracket 5. As FIG. 3 shows, the hand protection bracket 5 is mounted so as to be pivotable about a pivot axis 31. The hand protection bracket 5 has a bearing section 34, next to which a first arm 25 of a toggle-lever mechanism 24 extends. The first arm 25 is connected to a pivot lever 27 via a second arm 26. Together with a brake spring 28 and the toggle-lever mechanism 24, the pivot lever 27 forms a trigger mechanism 23 for the braking arrangement 55.

During a movement of the hand protection bracket 5 in the direction of the arrow 32, that is forward in the direction of the saw chain 7, the bearing section 34 entrains the first arm 25 of the toggle-lever mechanism 24. As a result, the toggle-lever mechanism 24 is guided over its dead point. As a result, the brake spring 28 can pivot the pivot lever 27 in the direction of the arrow 33 and thereby move a first end 29 of the brake band 15 away from the clutch drum 14. A second end 30 of the brake band 15 is mounted firmly on the housing 2. As a result, when the pivot lever 27 is pivoted in the direction of the arrow 33, the brake band 15 is pulled tight around the clutch drum 14 and, as a result, the brake is engaged. In order to release the braking arrangement 55, the hand protection bracket 5 is pivoted in the opposite direction to the arrow 32, that is the hand protection bracket 5 is pulled in the direction of the bale handle 4. In the process, the bearing section 34 carries along the first arm 25 into the position shown in FIG. 3. As a result, the brake spring 28 is tensioned and the toggle-lever mechanism 24 is guided over its dead point such that the force exerted by the brake spring 23 is absorbed via the toggle-lever mechanism 24. The hand protection bracket 5 always returns to its starting position after actuation in the direction of the arrow 32 or after actuation in the opposite direction. A restoring spring is provided for this purpose (not shown). Another braking arrangement 55 may also be advantageous for the motor-driven, chain saw 1. The structure of the braking arrangement 55 is independent of the structure, described below, of a blocking device for the start enrichment device of the motor-driven chain saw 1.

Figure 4:
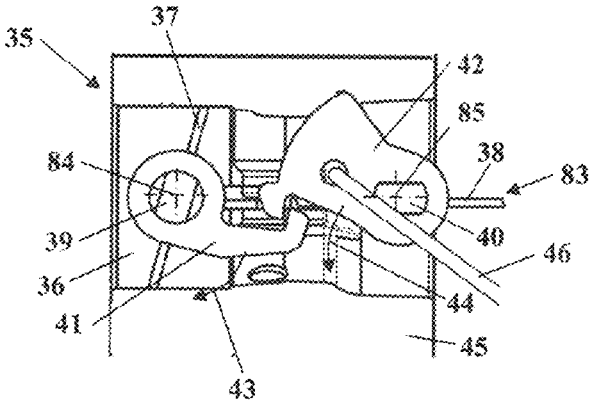
FIG. 4 shows a schematic illustration of the carburetor of the motor-driven chain saw of FIG. 1 in the operating position.

FIG. 4 schematically shows a carburetor 35 of the combustion engine 11. The carburetor 35 has a carburetor housing 45 in which there is formed an intake channel section 36 via which fuel/air mixture is supplied to the combustion engine 11. In the intake channel section 36, a throttle flap 37 is mounted in a pivotable manner about, a pivot axis 84 by way of a throttle shaft 39. With respect to the flow direction of the fuel/air mixture in the carburetor 35, upstream of the throttle flap 37 a choke flap 38 is mounted in a pivotable manner about a pivot axis 85 by way of a choke shaft 40. Instead of the throttle flap 37 and the choke flap 38, it is also possible to provide other choke elements or throttle elements, for example cylindrical choke or throttle elements. Outside the carburetor 35, a throttle trigger 41 is secured to the throttle shaft 39 and a choke lever 42 is secured to the choke shaft 40. For the sake of clarity, the intake channel section 36 is shown in section in FIG. 4 and the throttle trigger 41 and the choke lever 42 in side view. The throttle trigger 41 is connected to the throttle shaft 39 so as to rotate therewith and the choke lever 42 is connected to the choke shaft 40 so as to rotate therewith. However, the throttle trigger 41 and throttle shaft 39 and, respectively, the choke lever 42 and choke shaft 40 may also be rotatable with respect to one another, preferably through a structurally predetermined small angle, for example in order to compensate manufacturing tolerances.

The choke flap 38 can be actuated via a coupling rod 46 mounted on the choke lever 42, that is be pivoted about the pivot axis 85. The coupling rod 46 is connected to the operating mode selector 10. In the embodiment, the coupling rod 46 is mounted on the operating mode selector 1Q. The operating mode selector 10 forms, together with the coupling rod 46, the choke lever 42 and the choke flap 38, a start enrichment device of the combustion engine 11. The throttle trigger 41, too, is part of the start enrichment device. In order to set a start position 48 of the start enrichment device, the throttle trigger 41 first has to be pivoted out of the pivoting range of the choke lever 42. To this end, an operator has to press the throttle lever 8 shown in FIG. 1. As a result, the throttle trigger 41 pivots in the direction of the arrow 43 in FIG. 4. Subsequently, the operator can actuate the operating mode selector 10 in the direction of the arrow 60 shown in FIG. 1. As a result, the choke lever 42 pivots in the direction of the arrow 44 in FIG. 4 and the choke flap 38 is positioned transversely in the intake channel section 36 and thereby reduces the free flow cross section of the intake channel section 36.

Figure 5:
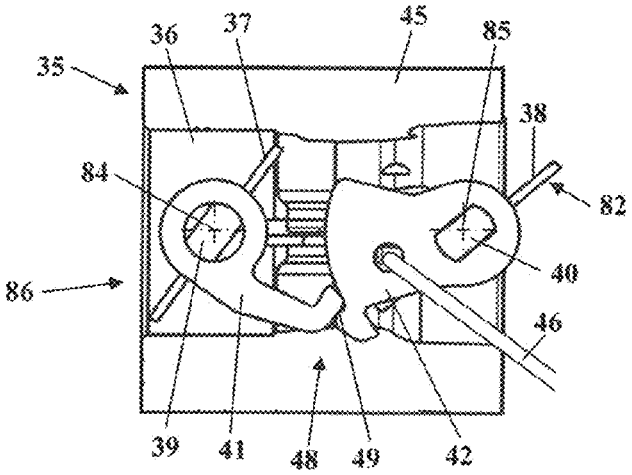
FIG. 5 shows a schematic illustration of the carburetor of FIG. 4 in the start position.

FIG. 5 shows the carburetor 35 in the start position 48. The start position 48 shown in FIG. 5 is a warm start position. In addition, a cold start position may also be provided. In the start position 48, the throttle trigger 41 fixes the choke lever 42. To this end, the throttle trigger 41 bears against a shoulder 49 of the choke lever 42. The throttle flap 37 is spring-biased in the direction of its completely closed position and the choke flap 38 is spring-biased in the direction of its completely open position. As a result the throttle trigger 41 and the choke lever 42 are mutually fixed. In the start position 48 shown in FIG. 5, the throttle flap 37 is slightly open. The choke flap 38 is partially closed. The choke flap 38 may be pivoted, for example through an angle of about 30° to 60° with respect to the operating position 83 shown in FIG. 4. In FIG. 5, the choke flap 38 is arranged in a start position 82 and the throttle flap 37 in a start position 86. In its start position 82, the choke flap 38 reduces the free flew cross section through the intake channel section 36. On account of the latching of the throttle trigger 41 with the choke lever 42, the operator can release the operating mode selector 10 (FIG. 1) after setting the start position 48. The throttle flap 37 and choke flap 38 remain in their start positions 82 and 86. As a result, the operator can actuate the starter device 21 (FIG. 2) with his free hand and simultaneously hold on to the motor-driven chain saw 1 by way of the bale handle 4.

Figure 6:
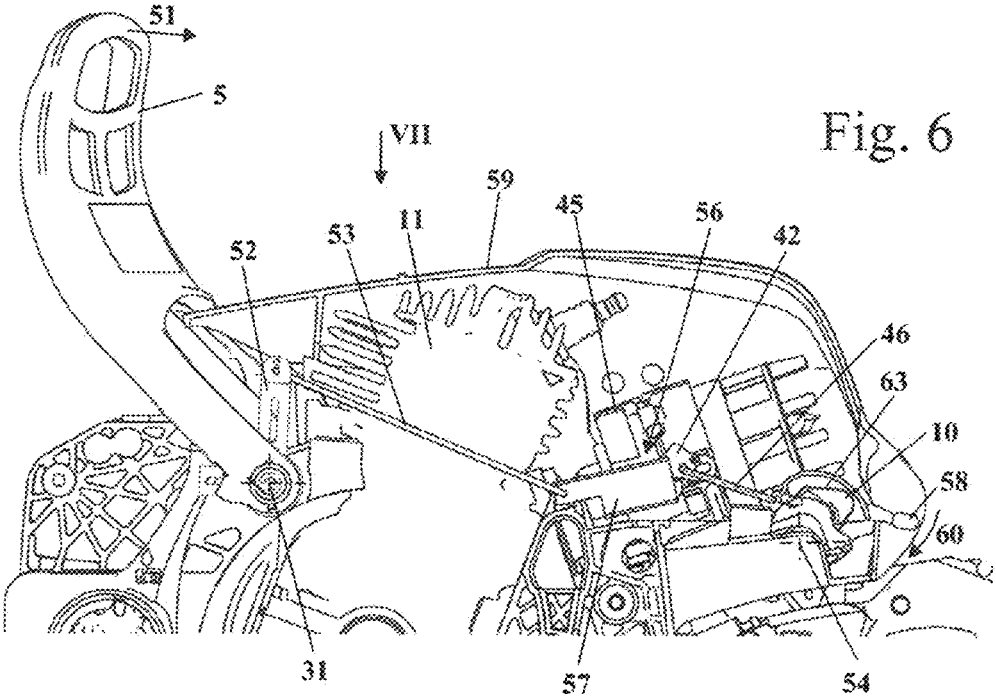
FIG. 6 shows a partially sectional side view of a first exemplary embodiment of the motor-driven chain saw of FIG. 1.

FIG. 6 shows a first exemplary embodiment of a blocking device 56 for the start enrichment device. In FIG. 6, the braking arrangement 55 is not engaged. An actuating lever 52, which is likewise mounted pivotably about the pivot axis 31, is connected to the hand protection bracket 5 via drivers (not shown). If the hand protection bracket 5 has been actuated in the direction of the arrow 51, that is pulled in the direction of the bale handle 4, then the actuating lever 52 is in the position shown in FIG. 6. The braking arrangement 55 is not actuated, that is the brake band 15 is not wrapped tightly around the clutch drum 14. Secured to the actuating lever 52 is an actuating element 53 which acts on a blocking element 57. In the exemplary embodiment, the actuating element 53 is a coupling rod, but some other actuating element 53, including a multipart actuating element 53, may also be provided. The blocking element 57 is guided via guides (not shown) on the housing 2, these guides being arranged advantageously in front of the drawing plane in FIG. 6. The blocking element 57 is configured as a slide. Some other configuration of the blocking element 57, for example as a pivot lever or the like, may also be advantageous. The blocking element 57 is arranged next to the carburetor housing 45 and projects into the region of the choke lever 42. In the side view in FIG. 6, the throttle trigger 41 is concealed by the blocking element 57.

FIG. 6 also shows the configuration of the operating mode selector 10 in detail. The operating mode selector 10 is mounted on the housing 2 so as to be pivotable about a pivot axis 54 and has an operating section 58 which projects out of the housing 2 and can be actuated by the operator. Held on the operating mode selector 10 is a spring 63 which serves as a contact spring for an ignition device of the combustion engine 11. In the off or stop position of the operating mode selector 10, the spring 63 bears against a short-circuit contact and short-circuits the ignition of the combustion engine 11 so that the combustion engine 11 stops. The spring 63 may simultaneously define latching positions of the operating mode selector 10. As FIG. 6 shows, the combustion engine 11 and the carburetor 35 are covered by a hood 59 of the housing 2.

Figure 7:
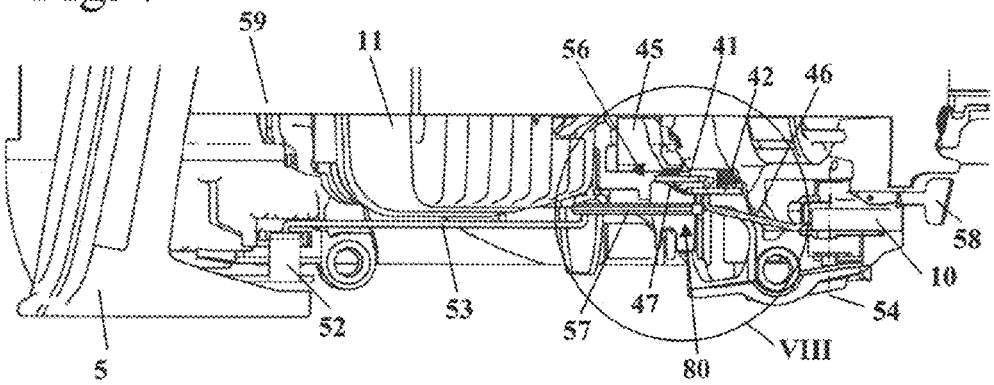
FIG. 7 shows a side view in the direction of the arrow VII of FIG. 6.
Figure 8:
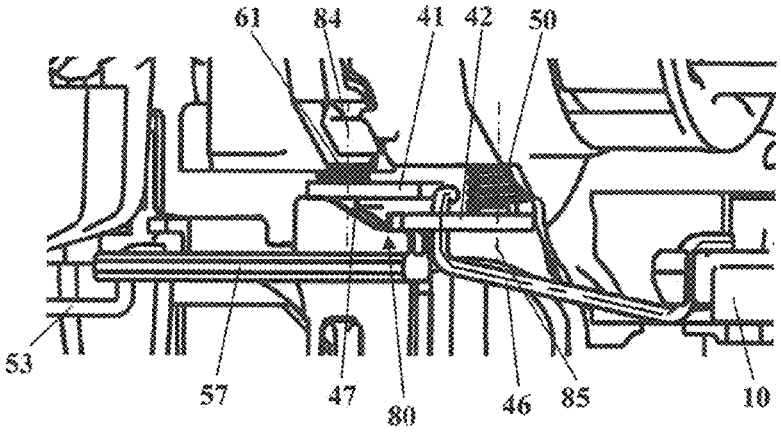
FIG. 8 shows the detail VIII of FIG. 7 in an enlarged view.

As FIG. 7 shows, the blocking element 57 has a displacement contour 47 which, in the blocking position 80 shown in FIGS. 6 and 7, displaces the throttle trigger 41 laterally in the direction of the carburetor housing 35. As the enlarged illustration in FIG. 8 shows, the choke lever 42 and the throttle trigger 41 are arranged in offset planes with respect to one another and cannot come into engagement with one another. The throttle trigger 41 has been displaced counter to the force of a spring 61 in the longitudinal direction of the pivot axis 84. The spring 61 is a torsion spring which biases the throttle flap 37 in the direction of its completely closed position. The choke lever 42 and the choke flap 38 are spring-biased by a spring 50 in the direction of the completely open position of the choke flap 38.

In the blocking position 80 shown in FIGS. 6 to 8, the operating mode selector 10 can be pivoted in the direction of the arrow 60 shown in FIG. 6 and the choke lever 42 can be pivoted until the choke flap 33 is in the start position 82 shown in FIG. 5. However, latching of the choke lever 42 with the throttle trigger 41 is not possible on account of the lateral offset between the two levers 41 and 42, and so the choke lever 42 and the choke flap 38 pivot back into the operating position 83 shown in FIG. 4 as soon as the operating mode selector 10 is released. As a result, it is not possible to engage the start position, that is to fix the choke flap 38 in the start position 82. As a result, the operator can not release the rear handle 3 to actuate the starter device 21 and cannot start the combustion engine 11.

It may also be provided for the blocking element 57 to act on the choke lever 42 and displace the choke lever 42 laterally out of the pivoting range of the throttle trigger 41 in order to prevent latching of the choke lever 42 and the throttle trigger 41.

Figure 9:
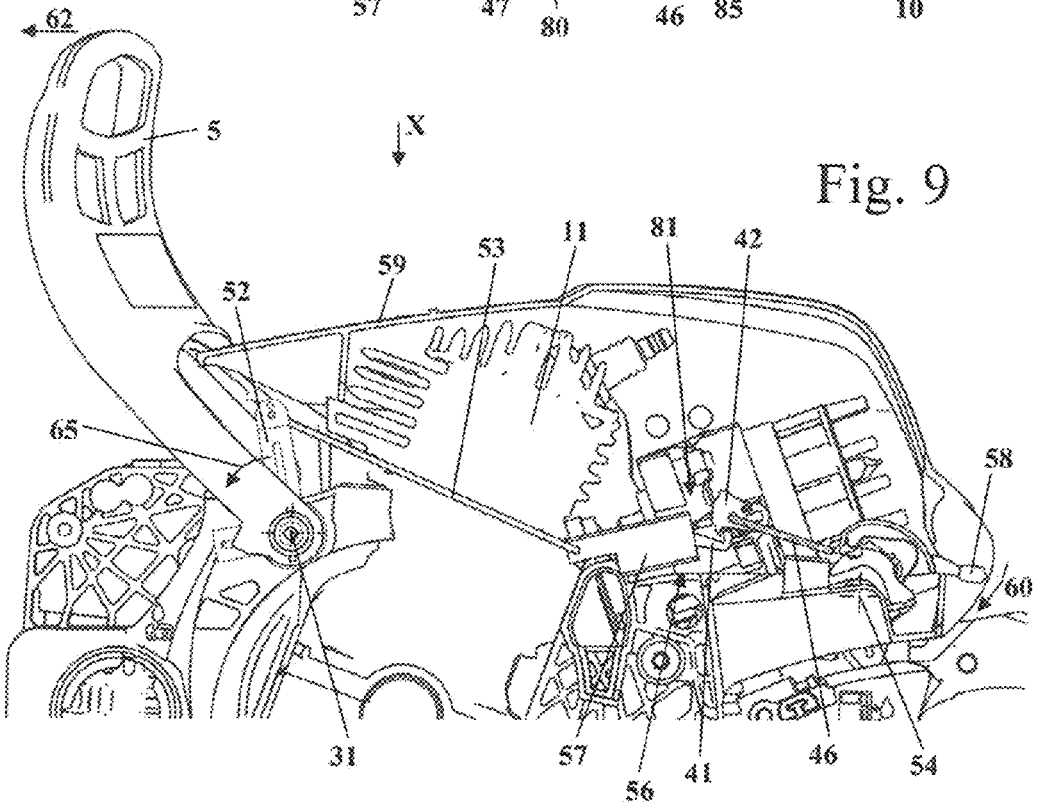
FIG. 9 shows the motor-driven chain saw of FIG. 6 with the blocking device released.
Figure 10:
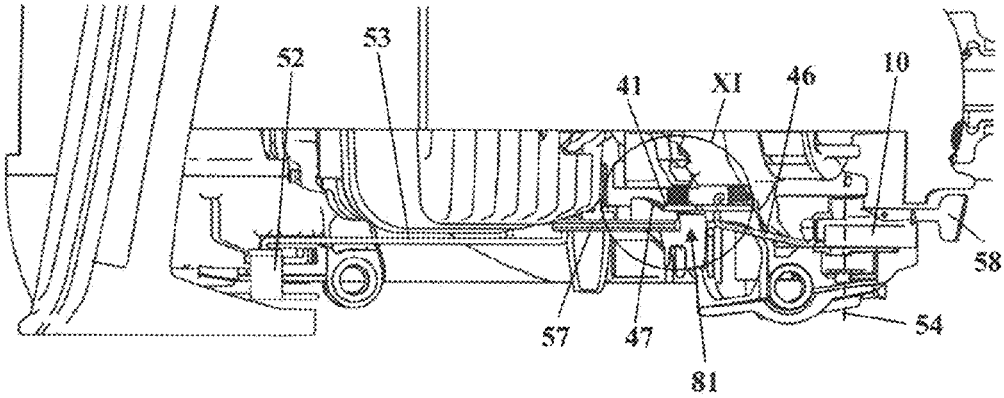
FIG. 10 shows a plan view in the direction of the arrow X of FIG. 9.
Figure 11:
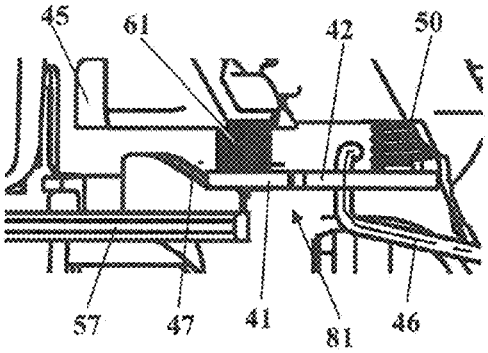
FIG. 11 shows the detail XI of FIG. 10 in an enlarged view.
Figure 12:
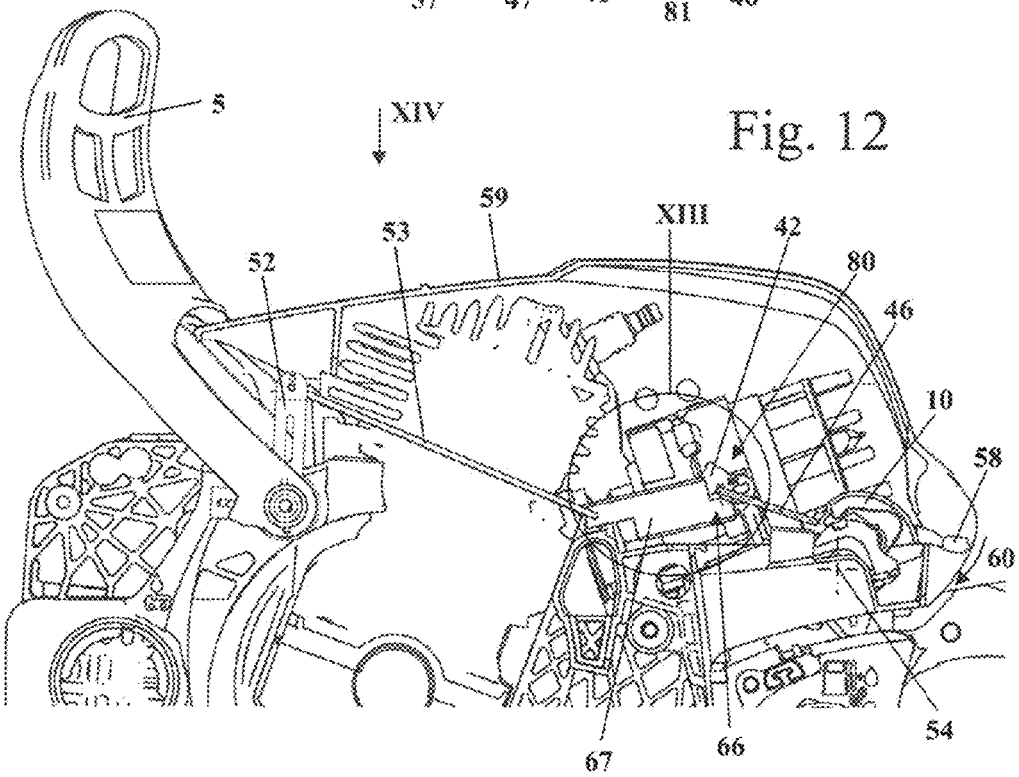
FIG. 12 shows a partially sectional side view of an embodiment of the motor-driven chain saw of FIG. 1.

FIGS. 9 to 11 show the blocking device 56 in the enabling position 81. In order to adjust the blocking device 56 from the blocking position 80 into the enabling position 81, the operator has to pivot the hand protection bracket 5 in the direction of the arrow 62 in FIG. 9, that is in the direction of the saw chain 7. As a result, the braking arrangement 55 is actuated and the brake band 15 pulled tight around the clutch drum 14. When the hand protection bracket 5 pivots, the hand protection bracket 5 carries the actuating lever 52 along in the direction of the arrow 65 in FIG. 9. As a result, the blocking element 57 is pulled away from the choke lever 42 and from the throttle trigger 41 in the direction of the hand protection bracket 5. As FIG. 10 shows, as a result the displacement contour 47 comes out of engagement with the throttle trigger 41. As FIG. 1I shows, as a result, the throttle trigger 41 has been pushed outward away from the carburetor housing 45 by the spring 61 and positioned in the same plane as the plane in which the choke lever 42 is arranged. If the operating mode selector 10 is actuated in the direction of the arrow 60 (FIG. 9), once the lever 8 has been actuated to pivot the throttle trigger 41, the start position 48 shown in FIG. 5 or a cold start position (not shown), which is reached by the operating mode selector 10 being pushed farther in the direction of the arrow 60, can be set.

In the enabling position 81 shown in FIGS. 9 to 11, the operator can accordingly set the start position 48 and subsequently release the operating mode selector 10 on account of the choke lever 42 being fixed by the throttle trigger 41. As a result, the operator has one hand free to actuate the starter device 21 (FIG. 2) and can thus start the combustion engine 11. On account of the blocking device 56, it is only possible to start the combustion engine 11 when the braking arrangement 55 is in its actuated position and the saw chain 7 is braked.

Figure 13:
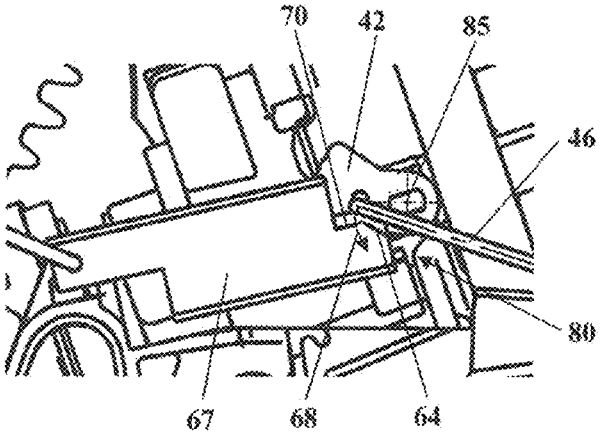
FIG. 13 shows the detail XIII of FIG. 12 in an enlarged view.

FIGS. 12 to 15 show a blocking device 66 in a blocking position 80. Identical reference numerals to the preceding figures indicate corresponding components. The blocking device 65 has a blocking element 67 on which the actuating element 53 acts. The blocking element 67, too, can be guided on the housing 2. In the blocking position 80 shown, a blocking contour 70, shown in FIG. 13, is arranged in the movement path of the coupling rod 46. The coupling rod 46 cannot be pivoted or can be pivoted only a little in the direction of the arrow 68 shown in FIG. 13. The coupling rod 46 cannot be pivoted until the choke flap 38 reaches the start position 48. On account of the blocking contour 70, the operator cannot actuate the operating mode selector 10 or Cannot actuate the latter far enough in the direction of the arrow 60, and it is not possible to engage a start position 48. Pivoting of the choke lever 42 about the pivot axis 85 is blocked by the blocking contour 70.

Figure 14:
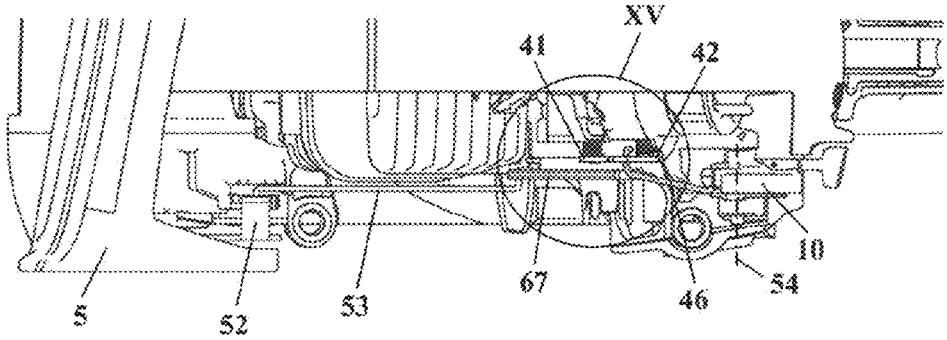
FIG. 14 shows a side view in the direction of the arrow XIV of FIG. 12.
Figure 15:
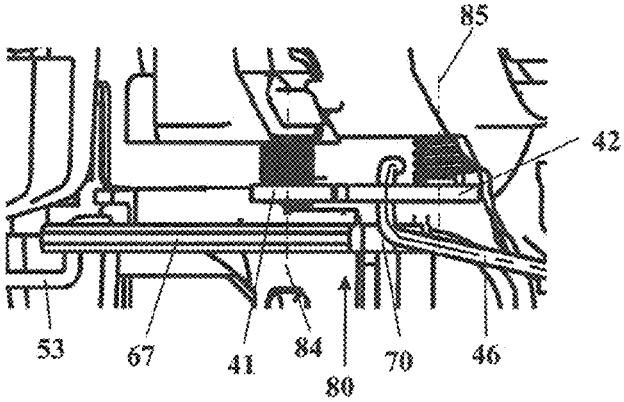
FIG. 15 shows the detail XV of FIG. 14 in an enlarged view.

As FIGS. 14 and 15 show, although the throttle trigger 41 and the choke lever 42 are located in the same plane, the throttle trigger 41 cannot fix the choke lever 42 in a start position 48 since the choke lever 42 cannot be pivoted far enough about the pivot axis 85. Alternatively, it is also possible to provide for the blocking contour 70 to prevent the throttle trigger 41 from pivoting. Even when the throttle flap 37 is not in its start position 86, it is usually not possible to start the combustion engine 11.

Figure 16:
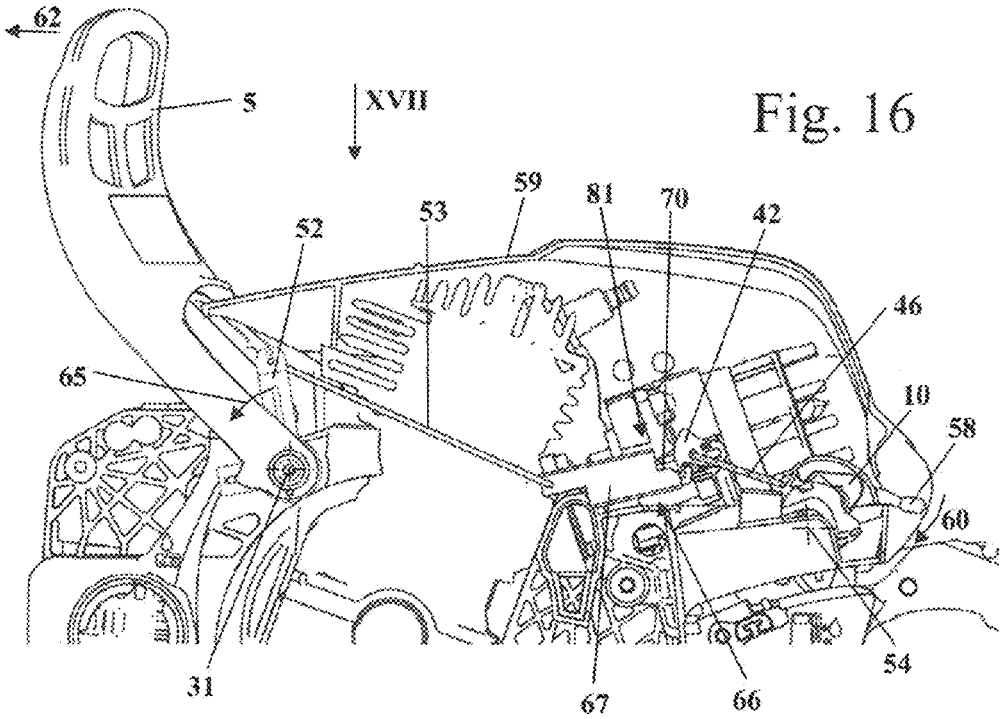
FIG. 16 shows the motor-driven chain saw of FIG. 12 with the blocking device released.
Figure 17:
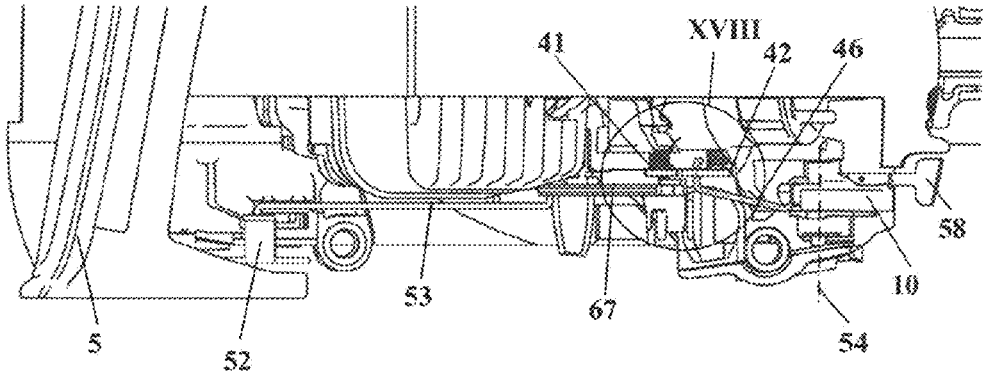
FIG. 17 shows a plan view in the direction of the arrow XVII of FIG. 16.
Figure 18:
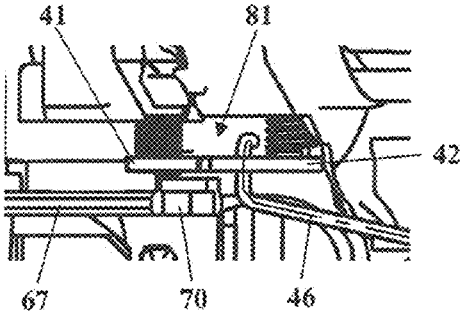
FIG. 18 shows the detail XVIII of FIG. 17 in an enlarged view.

FIGS. 16 to 18 show the blocking device 66 in the enabling position 81. The enabling position 81 is engaged by the hand protection bracket 5 being pivoted in the direction of the arrow 62 in FIG. 16. As a result, the braking arrangement 55 is actuated and the brake engaged. The actuating lever 52 pivots in the direction of the arrow 65 about the pivot axis 31, and as a result the blocking element 67 with the blocking contour 70 is moved out of the pivoting range of the coupling rod 46. This is also shown in FIGS. 17 and 18. Because the blocking contour 70 is not arranged in the pivoting range of the coupling rod 46, the operating mode selector 10 can be pivoted in the direction of the arrow 60 (FIG. 16) until the start position 48 is reached and as a result the start position 48 (FIG. 5) is engaged.

Figure 19:
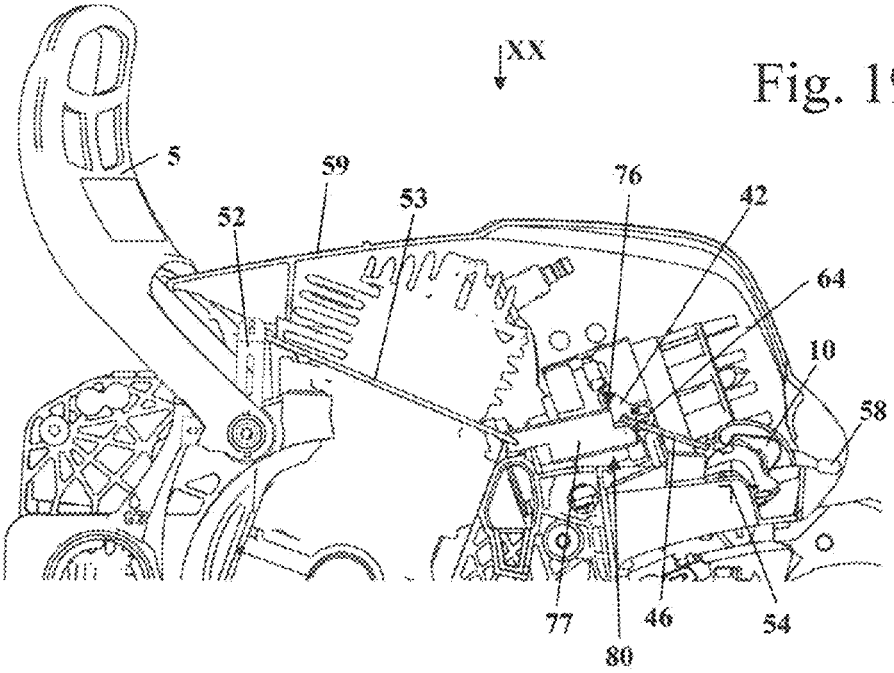
FIG. 19 shows a partially sectional side view of a further embodiment of the motor-driven chain saw.
Figure 20:
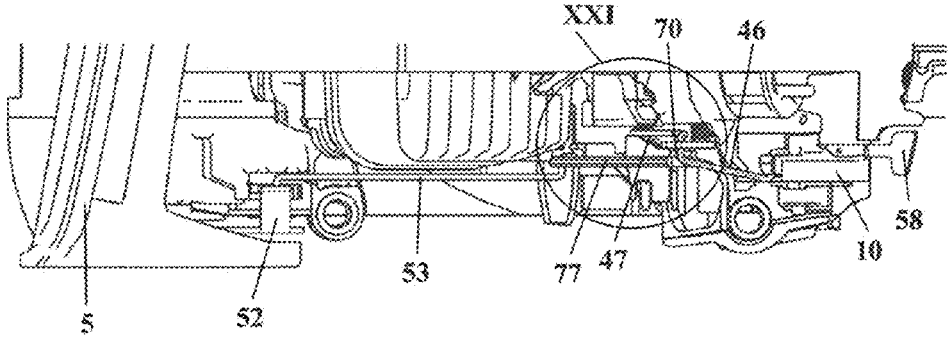
FIG. 20 shows a plan view in the direction of the arrow XX of FIG. 19.
Figure 21:
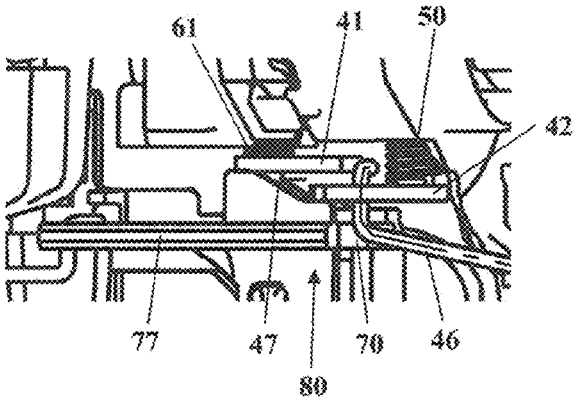
FIG. 21 shows the detail XXI of FIG. 20 in an enlarged view.

FIGS. 19 to 21 show an exemplary embodiment of a blocking device 76 which has a blocking element 77. The blocking element 77 has both a displacement contour 47 and a blocking contour 70. In the blocking position 80 shown in FIGS. 19 to 21, pivoting of the operating mode selector 10 is not possible, since the blocking contour 70 (FIG. 21) is arranged in the pivoting path of the coupling rod 46 and as a result prevents adjustment of the operating mode selector 10. Coupling between the throttle trigger 41 and the choke lever 42 is also not possible since the displacement contour 47 has laterally disengaged the throttle trigger 41 counter to the force of the spring 61 and has moved it out of the pivoting range of the choke lever 42. As a result, it is also not possible for the throttle trigger 41 and the choke lever 42 to latch.

Figure 22:
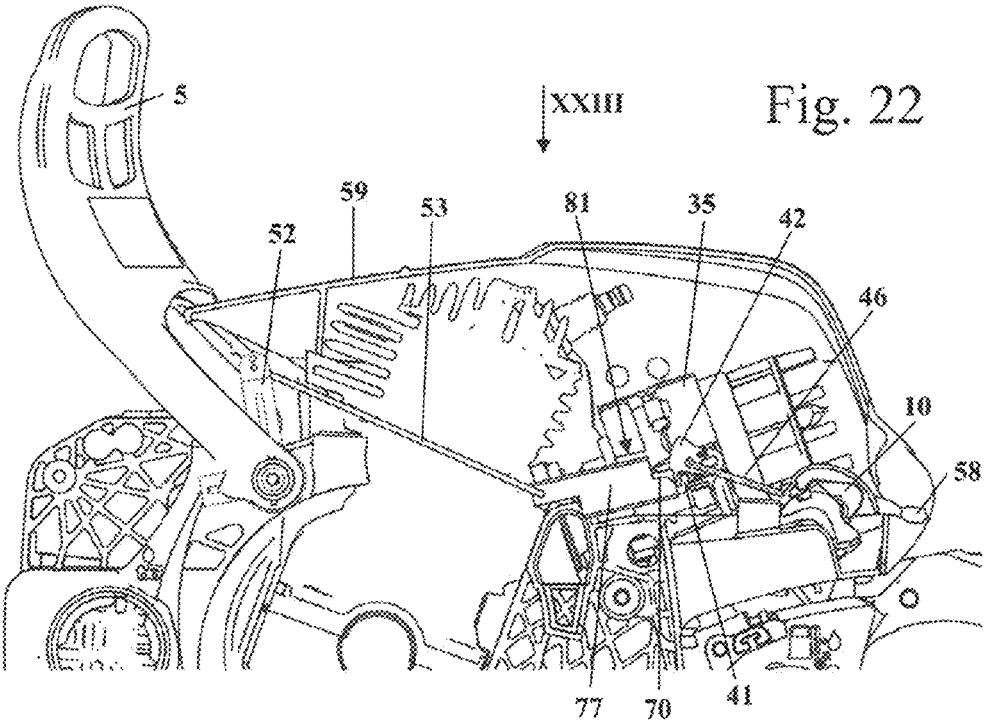
FIG. 22 shows the motor-driven chain saw of FIG. 19 with the blocking device released.
Figure 23:
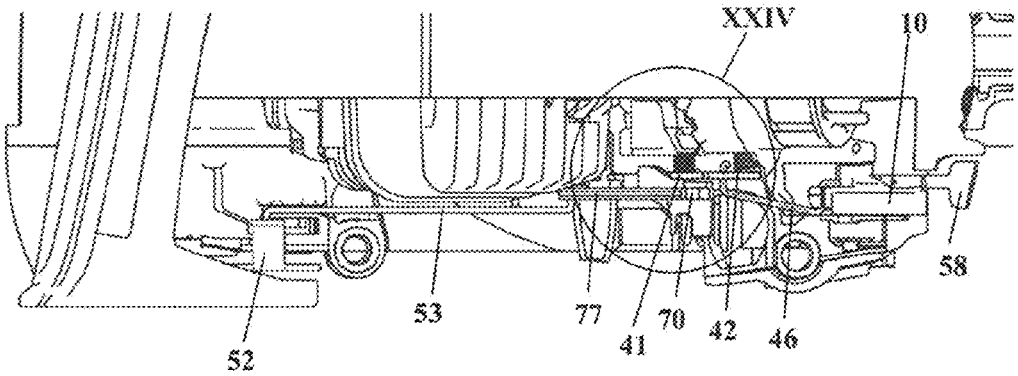
FIG. 23 shows a plan view in the direction of the arrow XXIII of FIG. 22.
Figure 24:
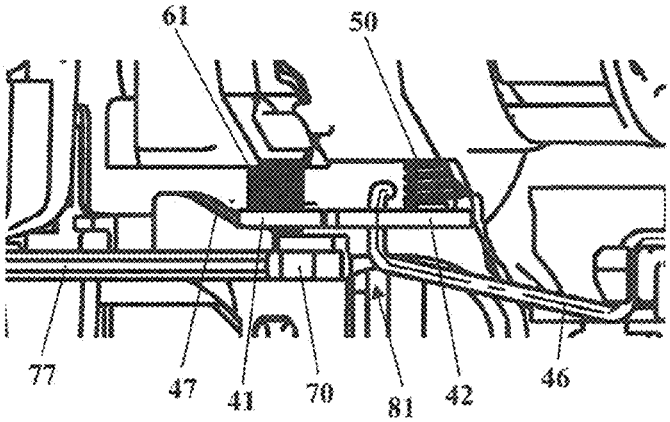
FIG. 24 shows the detail XXIV of FIG. 23 in an enlarged view.

FIGS. 22 to 24 show the blocking device 76 in the enabling position 81. In this position, the displacement contour 47 is no longer in engagement with the throttle trigger 41 and so the throttle trigger 41 and the choke lever 42 are arranged, in the same plane and can come into engagement with one another. At the same time, the blocking contour 70 has moved out of the pivoting range of the coupling rod 46 and so the choke lever 42 can be pivoted via the coupling rod 46 by pivoting of the operating mode selector 10. As a result, the start position 48 shown in FIG. 5 can be engaged; and subsequently the operating mode selector 10 can be released. On account of the latching between the choke lever 42 and the throttle trigger 41, the operating mode selector 10 remains in the start position 48.

In the case of the blocking devices 56 and 76, in addition or alternatively to the throttle trigger 41, the choke lever 42 can also be displaced in the longitudinal direction of its pivot axis 85 in order to position the choke lever 42 and throttle trigger 41 in offset planes with respect to one another and to prevent the levers 41, 42 from coming into engagement with one another.

On the blocking element 67 and on the blocking element 77, respectively, the blocking devices 66 and 76 have an actuating contour 64 which is shown in detail in FIG. 13 and FIG. 19. The actuating contour 64 is in the form of a slope. The actuating contour 64 returns the choke lever 42 into the operating position 83 of the choke flap 38 when the braking arrangement 55 is released, while the start enrichment device is in the start position 48. The start position 48 is also released via the displacement contour 47 in the case of the blocking devices 56 and 66, the displacement contour 47 laterally disengaging the throttle trigger 41 when the braking arrangement 55 is released. This ensures that an engaged start position 48 is released when the braking arrangement 55 is positioned in the released position of the brake. In order that it is possible to release the latching between the throttle trigger 41 and the choke lever 42 via the actuating contour 64, the throttle trigger 41 can be made of an elastic material, for example a plastics material.

Figure 25:
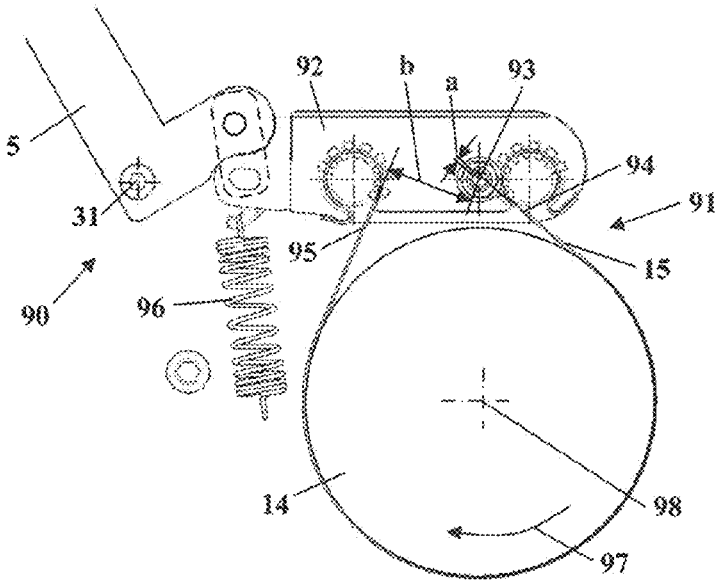
FIG. 25 snows a side view of an alternative embodiment of a braking arrangement.

FIG. 25 shows an alternative exemplary embodiment for a braking arrangement 90. The braking arrangement 90 has a differential band brake 91 which includes the brake band 15 and the clutch drum 14. Identical reference numerals to the preceding figures indicate corresponding elements. During operation, the clutch drum 14 rotates in a direction of rotation 97 about a rotational axis 98. The differential band brake 91 has a pivot lever 92 on which the hand protection bracket 5 acts. In FIG. 25, the braking arrangement 90 is shown in a braked position in which the brake band 15 wraps tightly around the clutch drum 14. The pivot lever 92 is mounted so as to be pivotable about a pivot axis 93 and is biased by a spring 96 in the direction of the unactuated, unbraked position of the differential band brake 91. The brake band 15 has a first end 94 and a second end 95. The two ends 94 and 95 of the brake band are secured to the pivot lever 92 at different distances from the pivot axis 93. The first end 94 is at a distance a from the pivot axis 93, said distance a being much smaller than a distance b of the second end 95 from the pivot axis 93. The distances a and b are in this case measured perpendicularly to the longitudinal direction of the ends 94 and 95. The distance b may advantageously be from about two times to about 20 times the distance a. The direction of rotation 97 is directed on the outer circumference of the clutch drum 14 from the first end 94 to the second end 95. As a result, the differential band brake acts in a self-reinforcing manner. The friction between the brake band 15 and the clutch drum 14 leads to a resultant moment on the pivot lever 92 in the actuating direction. As soon as the brake band 15 bears against the clutch drum 14, the braking action is reinforced and the brake band 15 is pulled automatically onto the clutch drum 14. As a result, only very small actuating forces are required to engage the differential band brake 91.

It is understood that the foregoing description is that of the preferred embodiments of the invention and that various changes and modifications may be made thereto without departing from the spirit and scope of the invention as defined in the appended claims.

What is claimed is:

1. A work apparatus comprising:

a work tool;

a combustion engine configured to drive said work tool;

a starting enrichment unit configured for said combustion engine and having at least a first starting position;

an operating mode selector configured to actuate said first starting position of said starting enrichment unit;

a braking arrangement having an actuated position and an unactuated position and being configured to brake said work tool when in said actuated position and to release said work tool in said unactuated position;

an actuating unit configured for said braking arrangement;

a blocking device having a blocking position and being configured to prevent said starting enrichment unit from assuming said first starting position when said blocking device is in said blocking position; and, said braking arrangement being coupled to said blocking device so as to cause said blocking device to be in said blocking position when said braking arrangement is in said unactuated position so as to cause said blocking device to prevent said first starting position from being assumed when said braking arrangement is unactuated.

2. The work apparatus of claim 1, wherein said starting enrichment unit has at least a first valve element having a valve operating position and a first valve starting position and being configured to be shiftable between said valve operating position and said first valve starting position.

3. The work apparatus of claim 2 further comprising:

a fixing device configured to hold said first valve element in said first valve starting position; and, said blocking device being configured to prevent said first valve element from being held in said first valve starting position.

4. The work apparatus of claim 2 further comprising:

a choke lever; and, said first valve element being a choke element connected to said choke lever.

5. The work apparatus of claim 4 further comprising:

a throttle trigger; and, a second valve element configured as a throttle element connected to said throttle trigger.

6. The work apparatus of claim 5, wherein:

said second valve element has a second valve starting position; and, said throttle trigger is configured to coact with said choke lever so as to hold one of said first valve starting position of said first valve element and said second valve starting position of said second valve element.

7. The work apparatus of claim 6, wherein said blocking device is configured to prevent said throttle trigger from engaging said choke lever.

8. The work apparatus of claim 6 further comprising:

a choke shaft;

a throttle shaft;

said choke lever having a first pivot axis defining a first longitudinal direction and being mounted on said choke shaft;

said throttle trigger having a second pivot axis defining a second longitudinal direction being mounted on said throttle shaft; and, at least one of said throttle trigger and said choke lever being mounted so as to be movable in the corresponding one of said first longitudinal direction of said first pivot axis and said second longitudinal direction of said second pivot axis.

9. The work apparatus of claim 8, wherein said blocking device has a displacement contour configured to move one of said throttle trigger and said choke lever in the direction of the corresponding one of said first pivot axis and said second pivot axis.

10. The work apparatus of claim 2, wherein said blocking device is configured to prevent said first valve element from moving into said first valve starting position.

11. The work apparatus of claim 2 further comprising:

a second valve element;

said blocking device being configured to prevent one of said first valve element and said second valve element from moving into the respective one of said first valve starting position and a second valve starting position.

12. The work apparatus of claim 10 further comprising:

a coupling rod defining a repositioning path;

said operating mode selector being configured to reposition said first valve element via said coupling rod; and, said blocking device being arranged in said respositioning path of said coupling rod.

13. The work apparatus of claim 2, wherein said first valve element is spring-biased in the direction toward said valve operating position.

14. The work apparatus of claim 1, wherein said braking arrangement includes a differential band brake.

15. The work apparatus of claim 1, wherein said actuating unit for said braking arrangement is a hand protection bracket.

16. A work apparatus comprising:

a work tool;

a combustion engine configured to drive said work tool;

a starting enrichment unit configured for said combustion engine and having at least a first starting position;

an operating mode selector configured to actuate said first starting position of said starting enrichment unit;

a braking arrangement having an actuated position and an unactuated position and being configured to brake said work tool when in said actuated position and to release said work tool in said unactuated position;

an actuating unit configured for said braking arrangement;

a blocking device having a blocking position and being configured to prevent said starting enrichment unit from assuming said first starting position when said blocking device is in said blocking position;

said braking arrangement being coupled to said blocking device so as to cause said blocking device to be in said blocking position when said braking arrangement is in said unactuated position; and, said blocking device having an actuating contour configured to release said starting enrichment unit from said first starting position when said braking arrangement is released when said starting enrichment unit is in said first starting position.

* * * * *